US010815675B1

(12) United States Patent
Lei

(10) Patent No.: US 10,815,675 B1
(45) Date of Patent: Oct. 27, 2020

(54) FLOOR BOARD OF RAPID SIDE-SLIDE INSTALLATION

(71) Applicant: ANHUI YANGZI FLOORING INCORPORATED COMPANY, Chuzhou (CN)

(72) Inventor: Xiang Lei, Chuzhou (CN)

(73) Assignee: ANHUI YANGZI FLOORING INCORPORATED COMPANY, Chuzhou (CN)

( * ) Notice: Subject to any disclaimer, the term of this patent is extended or adjusted under 35 U.S.C. 154(b) by 0 days.

(21) Appl. No.: 16/575,404

(22) Filed: Sep. 19, 2019

Related U.S. Application Data

(63) Continuation of application No. 16/398,302, filed on Apr. 30, 2019, now abandoned.

(51) Int. Cl.
*E04F 15/02* (2006.01)
*E04F 15/04* (2006.01)

(52) U.S. Cl.
CPC ..... *E04F 15/02038* (2013.01); *E04F 15/04* (2013.01); *E04F 2201/0523* (2013.01)

(58) Field of Classification Search
CPC ..... E04F 15/02038; E04F 15/04; E04F 2201/0523
USPC ..... 52/588.1
See application file for complete search history.

(56) References Cited

U.S. PATENT DOCUMENTS 2,281,929 A * 5/1942 Failor ..... 246/33
3,465,487 A * 9/1969 Coste ..... E04B 2/822 52/241
9,499,979 B2 * 11/2016 Huang ..... E04F 15/02038
2008/0141611 A1 * 6/2008 Chen ..... B27M 3/04 52/592.1
2009/0193741 A1 * 8/2009 Cappelle ..... E04F 15/102 52/309.1
2010/0313510 A1 * 12/2010 Tang ..... E04F 15/0215 52/403.1
2013/0104486 A1 * 5/2013 Windmoller ..... E04F 15/02033 52/588.1
2013/0318903 A1 * 12/2013 Choi ..... E04F 15/105 52/480

FOREIGN PATENT DOCUMENTS

DE 1914997 A1 * 10/1969 ..... B62D 29/045
GB 1317720 A * 5/1973 ..... E04C 2/38
NL 6904706 A * 9/1969 ..... B62D 29/045

* cited by examiner

*Primary Examiner* — Jeanette E Chapman
(74) *Attorney, Agent, or Firm* — Bayramoglu Law Offices LLC

(57) ABSTRACT

A floor board of rapid side-slide installation includes a board body and a plastic frame covering a periphery of the board body. A plurality of sets of limiting connectors are provided on the plastic frame. Two adjacent board bodies are fixed to each other by an engagement of the corresponding limiting connectors. A first groove is provided at the periphery upper surface of the board body and a protruding boss having an inclined side surface is formed between a top surface of the first groove and an upper surface of the board body. An acute angle is between the inclined side surface and the top surface of the first groove. The plastic frame is provided under the protruding boss and embedded in the first groove and an outer side wall of the plastic frame and a protruding edge of the protruding boss are on the same vertical plane.

20 Claims, 5 Drawing Sheets

FLOOR BOARD OF RAPID SIDE-SLIDE INSTALLATION

CROSS REFERENCE TO THE RELATED APPLICATIONS

This application is a continuation application of U.S. patent application Ser. No. 16/398,302, filed on Apr. 30, 2019, the entire contents of which are incorporated herein by reference.

TECHNICAL FIELD

The present invention relates to the technical field of flooring, and particularly to a floor board of rapid side-slide installation.

BACKGROUND

Solid wood floor board refers to the decorative floor board produced after the drying and machining of the wood, which is characterized by its natural patterns, comfortable foot feelings, and application safety. Hence, the solid wood board is commonly used in the floor decoration of a bedroom, living room, study room, and the like as a high-grade material. However, due to the natural characteristics that wet makes the wood expand and dry makes it contract, the traditional solid wood flooring has high requirements on the environment and conditions of use, because it tends to expand and deform after being affected with damp or absorbing water, and it tends to contract, deform, and even fracture after removing the water by heating. As a result, the floor boards would become damaged, so the application of the traditional solid wood floor boards is limited.

In order to gain a competitive edge in the market and meet the high requirements of the floor heat resistance for the flooring as the living standards of the consumers are upgraded, a high-temperature heat treatment for carbonization or a secondary moisture balance is usually applied to the solid wood blank. Then, the tongue and the groove of the wood board are sprayed with the edge sealing paint, the bottom surface is sprayed with the paint, and the tongue, the groove, and the bottom surface are subjected to a film-coating process. Alternatively, after the bottom surface is sprayed with the paint, and the tongue and the groove of the wood board are sealed with the wax, the bottom surface is subjected to the film-coating process to block the access of wood surface to water or moist air. Alternatively, the adverse effects of environmental temperature and humidity changes on the wood can be reduced to achieve the moisture-proof and moisturizing effects. However, the above flooring still have the following drawbacks. The heat treatment can change many natural properties of the wood, such as weakened physical properties, and darker wood color, etc. The secondary moisture balance treatment, although can protect the natural properties of the wood, it still has the following drawbacks. First, the paint coated on the tongue and the groove cannot completely cover the surface of the wood, so it only provides partial protection on moisture-proof and moisturizing. Second, the tongue and the groove are sealed with the wax, after the wax is applied, the wax film tends to get damaged and falls off due to the crashing during the movement and installation when the tongues and grooves of different boards are being put together, so the function of the wax is affected.

There is a solid wood plastic flooring which can obtain a good moisture-proof effect by providing a plastic edge-sealing frame on the side surface of the board body. However, in the injection molding of the plastic edge-sealing frame of the above solid wood plastic flooring, the plastic material tends to overflow to the surface of the board body, and the plastic frame around the floor board is quite outstanding after direct flooring, which affects the appearance of the flooring. Hence, a secondary treatment is required to remove the redundant plastic material on the surface of the board body after the injection molding. Thus, besides the increase of the production cost of the floor board, it is easy to damage the plastic edge-sealing frame during the secondary treatment which has complicated processes and is difficult. Meanwhile, the existing solid wood plastic floor boards are inconvenient and difficult to install.

SUMMARY

In order to solve the following problems, in the injection molding of the plastic edge-sealing frame of the existing solid wood plastic floor board or the plastic floor board of other base material, the plastic material tends to overflow to the surface of the board body, and the plastic frame around the floor board is quite outstanding after direct flooring, which affects the appearance of the floor board; hence, a secondary treatment is required to remove the redundant plastic material on the surface of the board body after the injection molding. Thus, besides the increase of the production cost of the floor board, it is easy to damage the plastic edge-sealing frame during the secondary treatment which has complicated processes and is difficult. Therefore, the present invention overcomes the above problems by providing a floor board of rapid side-slide installation.

In order to achieve the above objective, the following technical solutions are used in the present invention.

A floor board of rapid side-slide installation includes a board body and a plastic frame covering around the board body. A plurality of sets of limiting connectors are provided on the plastic frame. Two adjacent board bodies are fixed by an engagement of corresponding limiting connectors on the plastic frames around the board bodies. A first groove is provided on a periphery of the board body near an upper surface of the board body, and a protruding boss having an inclined side surface is formed between a top surface of the first groove and the upper surface of the board body. An angle between the inclined side surface and the top surface of the first groove is an acute angle. The plastic frame is provided under the protruding boss and is embedded in the first groove, and an outer side wall of the plastic frame and a protruding edge of the protruding boss are on the same vertical plane.

In an injection molding of the floor board of the present invention, the protruding boss on the periphery of the board body is fitted with an inner wall of a mold. Since the protruding boss has the inclined side surface, the protruding edge of the inclined side surface of the protruding boss and a side wall of the mold make an injection molding space isolated with the upper surface of the board body to prevent a plastic material from overflowing to the upper surface of the board body. After the injection molding, the plastic frame is formed on the periphery of the board body, and the plastic frame is partially embedded in the first groove to enhance a firmness of the board body and the plastic frame. Meanwhile, the plastic frame is provided under the protruding boss and an outer side wall of the plastic frame and the protruding edge of the protruding boss are on the same vertical plane. Therefore, after the injection molding of the board body, the plastic frame is hidden under the board body, and the plastic frame is invisible by vertically viewing from the upper surface of the board body, so the appearance of the flooring will not be affected after installation. No redundant plastic material is left on the upper surface of the board body, so no secondary treatment is required.

As a further improvement, the angle between the inclined side surface and the top surface of the first groove ranges from 80° to 89°.

As a further improvement, an area of the upper surface of the board body is larger than an area of a bottom surface of the board body, the periphery of the board body is between the upper surface and the bottom surface, the periphery of the board body is configured with a stepped shape, a second groove is provided on the periphery of the board body near the bottom surface of the board body, and the plastic frame is embedded in the second groove. The step shape is configured to set aside space for a formation of the limiting connectors for the slide installation, and a sliding rail surface for assembling the limiting connectors can be formed on the step. The second groove is configured to make the plastic frame partially embedded in the second groove during the injection molding, thereby further enhancing the firmness of the board body and the plastic frame.

As a further improvement, the plastic frame includes a bottom frame and a side frame provided inside the bottom frame and integrally formed with the bottom frame. Each set of the limiting connectors includes a first engaging member and a second engaging member which are adjacent to each other. The first engaging member protrudes outward from a side wall of the side frame, and the first engaging member is connected to a bottom surface of the bottom frame. The second engaging member protrudes downward from the bottom surface of the bottom frame, and the first engaging member and the second engaging member on two sides of the side frame are arranged in a staggered manner, wherein, a distance between the first engaging member in one set of limiting connectors and the second engaging member in the adjacent set of limiting connectors is greater than a length of the first engaging member. By configuring the first engaging member and the second engaging member on the two sides of the side frame in the staggered manner, the first engaging member and the second engaging member of the two adjacent floor boards are matched and engaged with each other. During the installation, the same engaging members, i.e. the first engaging members or the second engaging members, of the two adjacent floor boards are staggered, and the mating engaging members of the two adjacent floor boards are aligned and matched to each other. Then, one of the two floor boards is side slid to make them assembled together through a limiting function of the first engaging member and the second engaging member, and a displacement is avoided. The installation process is quite simple, and floor boards are reusable. Moreover, it is unnecessary to distinguish the left and right of the limiting connectors of the floor boards, so the installation efficiency can be further improved and the installation difficulty can be reduced.

As a further improvement, an upper surface of a protruding portion of the first engaging member is provided with a first engaging portion that protrudes upward. A first limiting groove is formed between the first engaging portion and a side wall of the bottom frame. A second limiting groove is formed between the second engaging member and a side wall of the side frame. During assembling, the first engaging portion slides into the second limiting groove of a floor board to be assembled with the floor board of the first engaging portion, and the second engaging member slides into the first limiting groove of the floor board to be assembled for matching and positioning. During installation, the first engaging portion of the floor board is engaged with the second limiting groove of the floor board to be assembled. Meanwhile, the second engaging member of the floor board to be assembled is engaged with the first limiting groove of the floor board to form a mutual locking.

As a further improvement, a width of the first limiting groove is greater than or equal to a width of the second engaging member, and a width of the second limiting groove is greater than or equal to a width of the first engaging portion. In order to enhance the fixation of the floor boards after assembling, the width of the first limiting groove is equal to the width of the second engaging member, and the width of the second limiting groove is equal to the width of the first engaging portion, so as to improve the stability.

As a further improvement, the first engaging portion is a strip block having a semicircular or square cross-section, and chamfers are provided at both ends of the strip block. The two ends of the first engaging portion are provided with the chamfers to facilitate the engagement during assembling.

As a further improvement, the second engaging member is a strip block having a semicircular or square part, and chamfers are provided at both ends of the strip block. The two ends of the second engaging member are provided with the chamfers to facilitate the engagement of during assembling.

As a further improvement, a length of the first engaging portion is equal to a length of the second limiting groove.

As a further improvement, a length of the second engaging member is equal to a length of the first limiting groove.

As a further improvement, a length of the first engaging portion is equal to a length of the second engaging member, and a height of the first engaging portion is equal to a height of the second engaging member.

As a further improvement, the board body is composed of a front board provided on the upper surface of the board body and a back board connected to the front board and provided on the bottom surface of the board body. The first groove is provided at a periphery of the front board, the second groove is provided at a periphery of the back board, and the bottom frame is provided at a back surface of the front board. The back board is provided in a receiving cavity surrounded by the side frame.

As a further improvement, an outer edge of the bottom frame is aligned with an outer edge of the front board.

As a further improvement, the back board is composed of a plurality of board cores, and a spacing between adjacent board cores ranges from 0.5 mm to 1.5 mm.

As a further improvement, the bottom surface of the board body is provided with a waterproof film, a cross-section of the waterproof film is U-shaped, and an outer edge of the waterproof film is located between the bottom frame and the board body.

As a further improvement, an end of the outer edge of the waterproof film is connected in the second groove in an overlapping manner.

As a further improvement, the waterproof film has a thickness ranging from 0.08 mm to 0.12 mm.

As a further improvement, a first paint layer is further provided between the waterproof film and the board body, and the first paint layer has a thickness ranging from 0.05 mm to 0.25 mm.

As a further improvement, the bottom surface of the board body is provided with a second paint layer, and the second paint layer has a thickness ranging from 0.05 mm to 0.25 mm.

As a further improvement, the upper surface of the board body is provided with a third paint layer.

Compared to the prior art, the present invention has the following advantages.

1. In the injection molding of the floor board of the present invention, the protruding boss on the periphery of the board body is fitted with the inner wall of the mold. The protruding edge of the inclined side surface of the protruding boss and the side wall of the mold make an injection molding space isolated with the upper surface of the board body to prevent the plastic material from overflowing to the upper surface of the board body. No redundant plastic material is left on the upper surface of the board body and no secondary treatment is required. Therefore, the cost for the secondary treatment of the redundant plastic material is saved and the production efficiency is improved.

2. After the injection molding, the plastic frame is formed on the periphery of the board body of the floor board, and the plastic frame is partially embedded in the first groove to enhance the firmness of the board body and the plastic frame. Meanwhile, the plastic frame is provided under the protruding boss and the outer side wall of the plastic frame and the protruding edge of the protruding boss are on the same vertical plane. Therefore, after the injection molding of the board body, the plastic frame is hidden under the board body, and the plastic frame is invisible by vertically viewing from an upper surface of the board body, so the appearance of the floor board will not be affected after installation.

3. The angle between the inclined side surface and the top surface of the first groove is an acute angle. Since the solid wood blank is exposed to the natural environment during the processing, due to the influence of temperature and humidity, wet makes the wood itself expand and dry makes it contract, so deformation occurs. However, since the density of a piece of wood varies at different parts, the deformation is also irregular, so the side wall of the protruding boss of the board body fitted with the plastic frame is unsmooth, which will lead to material leakage. In order to ensure that there is no gap between the side wall of the protruding boss of the board body at the wood-plastic fitting surface and the mold, the wood is machined to a certain extent to provide an inclination angle. If the inclination angle is greater than 90 degrees, the expected effect will not be achieved. If a sharp inclination is provided, an unexpected gap will be left between the two floor boards in assembling, thereby affecting the appearance of floor board. The range of the inclination angle provided by the comparison tests is 80° to 89°. Moreover, the experiments leaded by the inventor found that similar technical effects can be obtained for other base materials with such an arrangement.

4. By configuring the first engaging member and the second engaging member on the two sides of the side frame in the staggered manner, the first engaging member and the second engaging member of the two adjacent floor boards are matched and engaged with each other. During the installation, the same engaging members, i.e. the first engaging members or the second engaging members, of the two adjacent floor boards are staggered, and the mating engaging members of the two adjacent floor boards are aligned and matched to each other. Then, one of the two floor boards is side slid to make them assembled together through a limiting function of the first engaging member and the second engaging member, and a displacement is avoided. The installation process is quite simple, and floor boards are reusable. Moreover, it is unnecessary to distinguish the left and right of the limiting connectors of the floor boards, so the installation efficiency can be further improved and the installation difficulty can be reduced.

Figure 1:
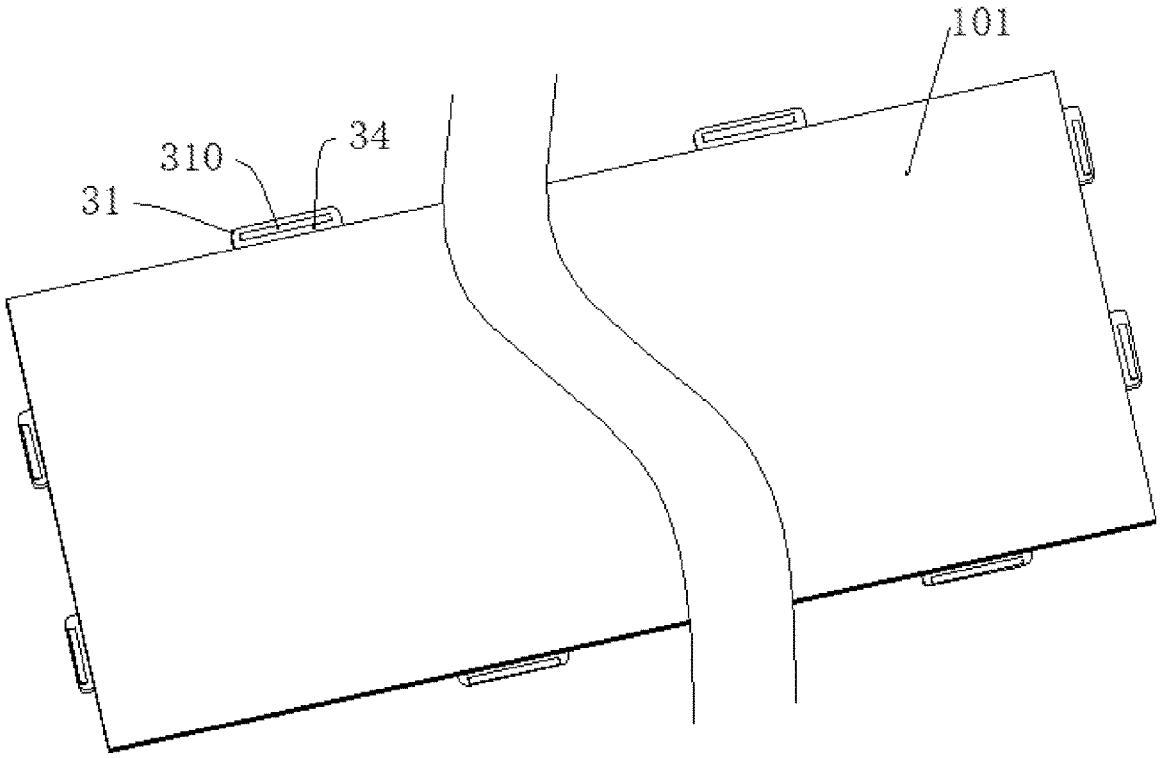
FIG. 1 is a schematic diagram showing a front structure of a floor board of rapid side-slide installation according to an embodiment of the present invention.

Reference designators in the drawings are as follows: 1—board body, 11—front board, 12—back board, 13—periphery of board body, 14—first groove, 15—protruding boss, 16—second groove, 100—first floor board, 101—upper surface of board body, 102—bottom surface of board body, 120—board core, 130—inclined side surface, 140—top surface of first groove, 131—protruding edge, 2—plastic frame, 21—bottom frame, 22—side frame, 200—second floor board, 221—first side board, 222—second side board, 223—third side board, 224—fourth side board, 3—limiting connector, 31—first engaging member, 32—second engaging member, 33—second limiting groove, 34—first limiting groove, 300—first space, 310—first engaging portion, 4—waterproof film, 41—end of outer edge of waterproof film, 400—second space, 5—third paint layer, 6—lower mold, 61—fixed side wall, and 7—first sliding block.

DETAILED DESCRIPTION OF THE EMBODIMENTS

The present invention is further described with reference to the embodiments. The described embodiments are merely a part of embodiments of the present invention, rather than all. Based on the embodiments of the present invention, other embodiments achieved by those of ordinary skill in the art without creative efforts should be considered as falling within the scope of the present invention.

Embodiment 1

Figure 2:
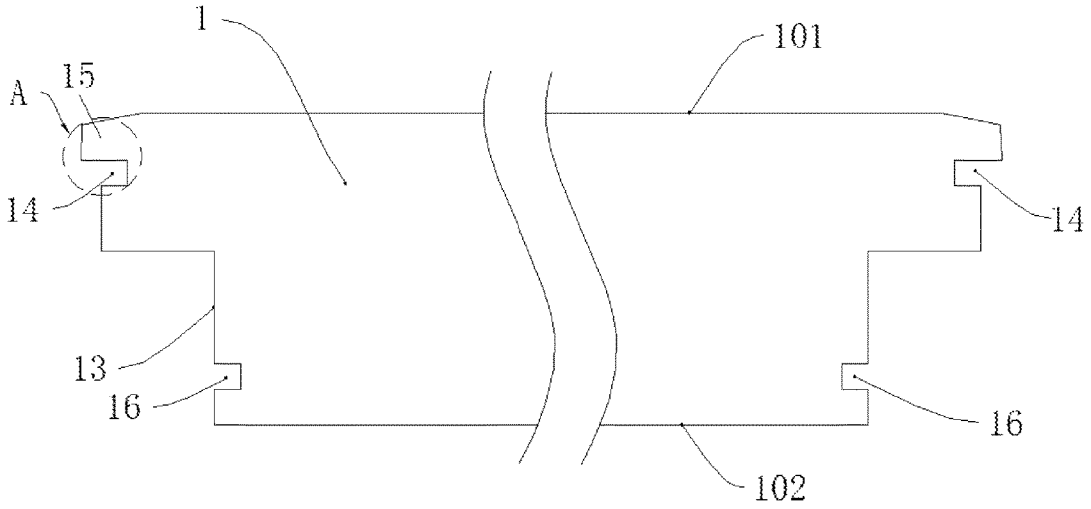
FIG. 2 is a cross-sectional view of a board body of a floor board of rapid side-slide installation according to an embodiment of the present invention.
Figure 3:
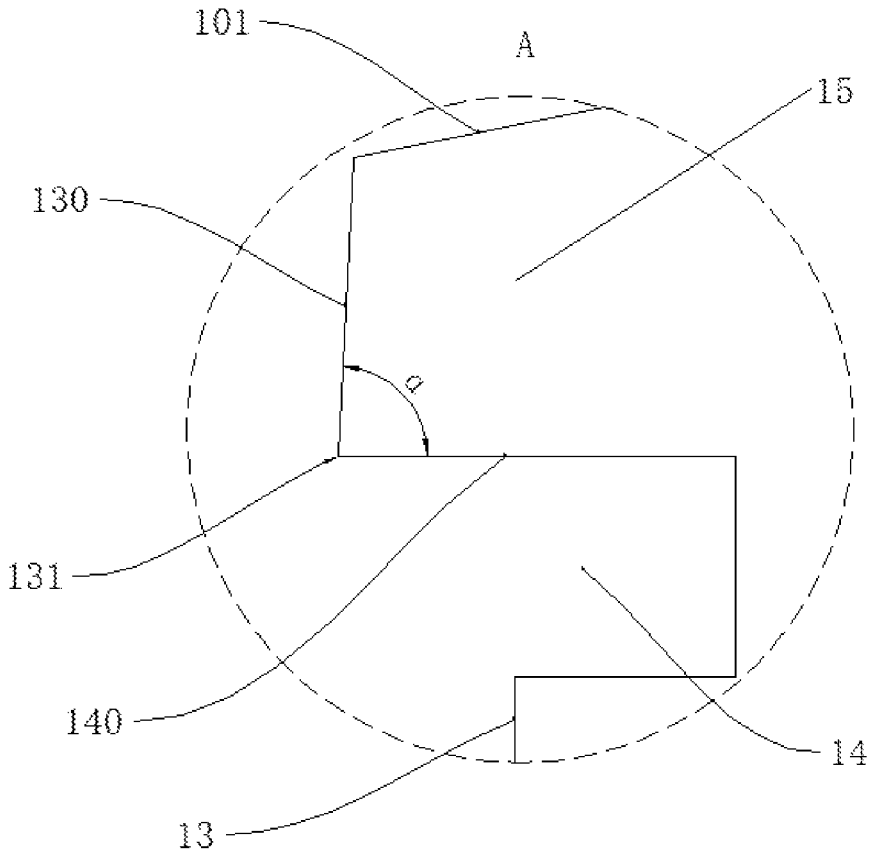
FIG. 3 is an enlarged view of a portion A of FIG. 2.
Figure 4:
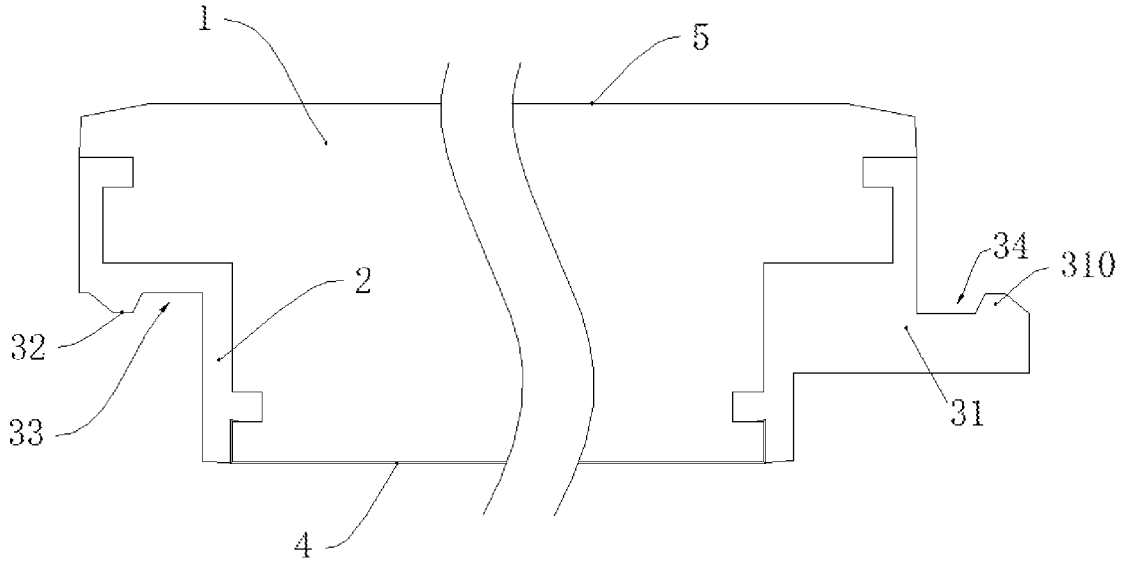
FIG. 4 is a cross-sectional view of FIG. 1.

As shown in FIG. 1 and FIG. 2, a floor board of rapid side-slide installation includes the board body 1 and the plastic frame 2 covering around the periphery 13 of the board body. In the present embodiment, the board body 1 may be any one of a shaving board, a solid wood board, a hardwood integrated board, a wood particle board, and a particle board, etc., and the water content of the board body 1 is controlled to be within 8% to 10% by weight. A plurality of sets of limiting connectors 3 are provided on the plastic frame 2. Two adjacent board bodies 1 are fixed with each other by an engagement of corresponding limiting connectors 3 on the plastic frames 2 of the peripheries 13 of the board bodies. The first groove 14 is provided on the periphery 13 of the board body near the upper surface 101 of the board body, and the protruding boss 15 having the inclined side surface 130 is formed between the top surface 140 of the first groove and the upper surface 101 of the board body. An angle between the inclined side surface 130 and the top surface 140 of the first groove is an acute angle, as shown in FIG. 3. Specifically, the protruding edge 131 is formed at the intersection of the inclined side surface 130 of the protruding boss 15 and the top surface 140 of the first groove. The plastic frame 2 is provided under the protruding boss 15 and embedded in the first groove 14. The cross-section of the first groove 14 has a shape of a horizontal dovetail groove having its opening facing outward. As shown in FIG. 4, in the present embodiment, the cross-section of the first groove 14 has a horizontal U shape with its opening facing outward or a horizontal U shape with an acute angle and its opening facing outward. There are various shapes that could be applied to the first groove 14, which are not listed herein. An outer side wall of the plastic frame 2 and the protruding edge 131 of the protruding boss 15 are on the same vertical plane. The angle between the inclined side surface 130 and the top surface 140 of the first groove ranges from 80° to 89°. Preferably, the angle $\alpha$ is 87°.

Since the blank of the board body 1 is exposed to the natural environment during the processing, with the influence of temperature and humidity, wet makes the wood expand and dry makes it contract. However, since the density of a piece of wood varies at different parts, the deformation is also irregular, so the side wall of the protruding boss 15 of the board body 1 fitted with the plastic frame 2 is unsmooth, which will lead to a material leakage. In order to ensure that there is no gap between the side wall of the protruding boss 15 of the board body 1 at the wood-plastic fitting surface and the mold, the wood is machined to a certain extent to provide an inclination angle. If the inclination angle is greater than 90 degrees, the expected effect will not be achieved. If there is a sharp inclination, an unexpected gap will be left when two floor boards are assembled together, thereby affecting the appearance. The range of the inclination angle $\alpha$ provided by the comparison test is 80° to 89°.

In the injection molding of the floor board according to the present invention, protruding boss 15 on the periphery 13 of the board body is fitted with the inner wall of a mold. Since the protruding boss 15 has the inclined side surface 130, the protruding edge 131 of the inclined side surface 130 of the protruding boss 15 and a side wall of the mold make an injection molding space isolated with the upper surface 101 of the board body to prevent the plastic material from overflowing to the upper surface 101 of the board body. After the injection molding, the plastic frame 2 is formed on the periphery 13 of the board body, and the plastic frame 2 is partially embedded in the first groove 14 to enhance a firmness of the board body 1 and the plastic frame 2. Meanwhile, the plastic frame 2 is provided under the protruding boss 15 and the outer side wall of the plastic frame 2 and the protruding edge 131 of the protruding boss 15 are on the same vertical plane. Therefore, after the injection molding of the board body 1, the plastic frame 2 is hidden under the board body 1, and the plastic frame 2 is invisible by vertically viewing from the upper surface 101 of the board body, and the appearance of the floor board is not affected after assembling. No redundant plastic material is left on the upper surface 101 of the board body, and no secondary treatment is required.

Embodiment 2

As shown in FIG. 2, this embodiment is an optimized solution of embodiment 1. The description of the present embodiment focuses on the improvements on embodiment 1, and the identical contents are not repeated herein. In the present embodiment, an area of the upper surface 101 of the board body is larger than an area of the bottom surface 102 of the board body, the periphery 13 of the board body is located between the upper surface and the bottom surface, the periphery 13 of the board body is provided with a stepped shape, the second groove 16 is provided on the periphery 13 of the board body near the bottom surface 102 of the board body, and the plastic frame 2 is embedded in the second groove 16. The cross-section of the second groove 16 is a horizontal dovetail groove with its opening facing outward. As shown in FIG. 4, in the present embodiment, the cross-section of the second groove 16 has a horizontal U shape with its opening facing outward or a horizontal U shape with an acute angle and its opening facing outward. There are various shapes can be applied to the second groove 16, which are not listed herein. The stepped shape is configured to set aside a space for the formation of the limiting connectors 3 for sliding assembling, and a sliding rail surface for the assembling of the limiting connectors 3 is formed on the step. The second groove 16 is configured to make the plastic frame 2 partially embedded in the second groove 16 during the injection molding, thereby further enhancing the firmness of the board body 1 and the plastic frame 2.

Embodiment 3

Figure 5:
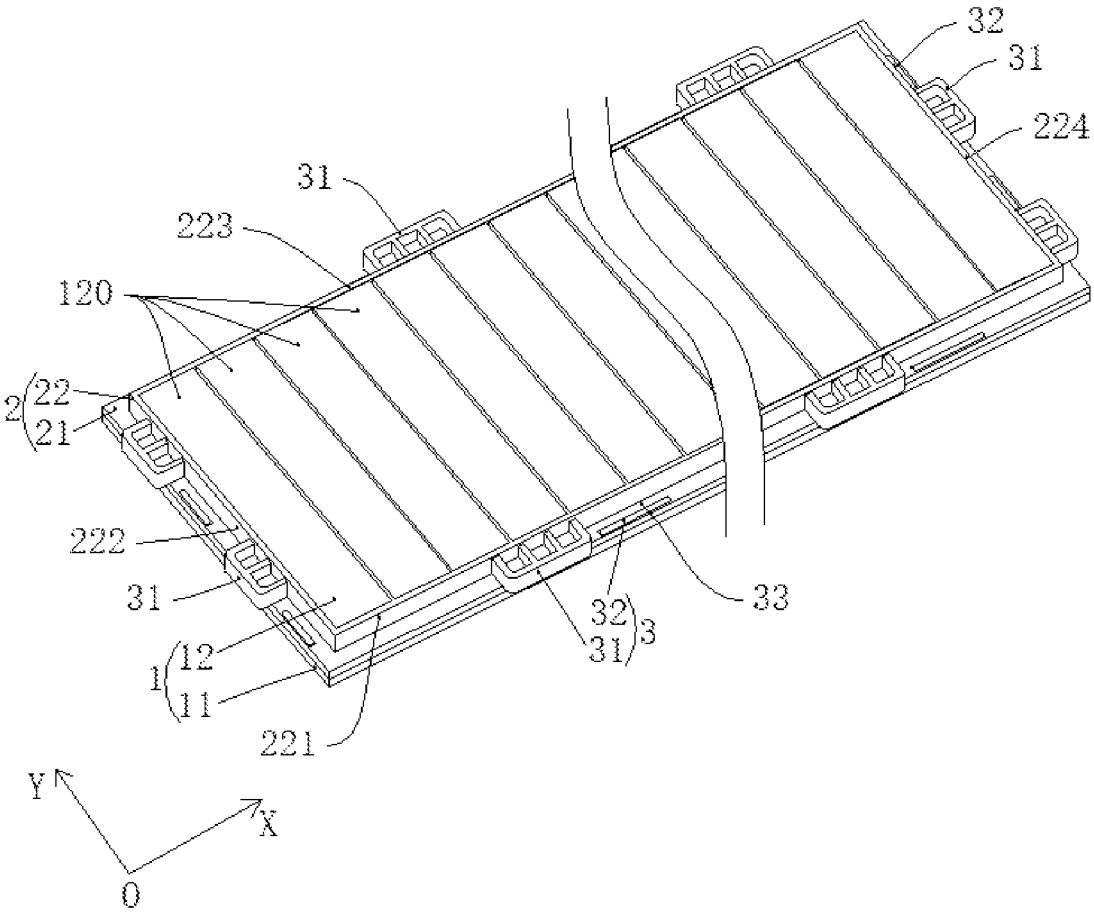
FIG. 5 is schematic diagram showing the structure of a rear side of FIG. 1.

As shown in FIG. 5, this embodiment is an optimized solution of embodiment 2. The description of the present embodiment focuses on the improvements on embodiment 2, and the identical contents are not repeated herein. In the present embodiment, the plastic frame 2 includes the bottom frame 21 and the side frame 22 provided inside the bottom frame 21 and integrally formed with the bottom frame 21. Each set of the limiting connectors 3 includes the first engaging member 31 and the second engaging member 32 which are adjacent to each other. The first engaging member 31 protrudes outward from a side board of the side frame 22, and the first engaging member 31 is connected to a bottom surface of the bottom frame 21. The second engaging member 32 protrudes downward from the bottom surface of the bottom frame 21, and the first engaging member 31 and the second engaging member 32 on two sides of the side frame 22 are arranged in a staggered manner.

The side frame 22 includes the first side board 221, the second side board 222, the third side board 223, and the fourth side board 224. In the lateral direction (i.e., the X-axis direction in FIG. 5), the first engaging member 31 and the second engaging member 32 on both sides of the side frame 22 are arranged in the staggered manner, namely, the first engaging member 31 on the outer side of the first side board 221 corresponds to the second engaging member 32 on the outer side of the third side board 223, and the second engaging member 32 on the outer side of the first side board 221 corresponds to the first engaging member 31 on the outer side of the third side board 223. In the longitudinal direction (i.e., the Y-axis direction in FIG. 5), the first engaging member 31 and the second engaging member 32 on both sides of the side frame 22 are arranged in the staggered manner, namely, the first engaging member 31 on the outer side of the second side board 222 corresponds to the second engaging member 32 on the outer side of the fourth side board 224, and the second engaging member 32 on the outer side of the second side board 222 corresponds to the first engaging member 31 on the outer side of the fourth side board 224. In the present application, the term "correspond" means that, when two floor boards are assembled, the first engaging portion 310 at the outer side of the first side board 221 of the first floor board 100 is matched and engaged with the second engaging member 32 at the outer side of the third side board 223 of the second floor board 200, and the second engaging member 32 at the outer side of the first side board 221 of the first floor board 100 is matched and engaged with the first engaging portion 310 at the outer side of the third side board 223 of the second floor board 200.

Specifically, a distance between the first engaging member 31 in one set of limiting connectors 3 and the second engaging member 32 in the adjacent set of limiting connectors 3 is greater than a length of the first engaging member 31. The first engaging member 31 and the second engaging member 32 on the two sides of the side frame 22 are arranged in the staggered manner, so that the first engaging member 31 and the second engaging member 32 of the adjacent two floor boards are matched and engaged with each other. In the assembling, the same engaging members, i.e. the first engaging members 31 and the second engaging members 32, of the adjacent two floor boards are staggered, and the mating engaging members of the adjacent two floor boards are aligned and matched with each other. Then one of the two floor boards is side slid to make them assembled through a limiting function of the first engaging member 31 and the second engaging member 32, and a displacement is avoided. The installation process is quite simple, and floor boards are reusable. Moreover, it is unnecessary to distinct the left and right of the limiting connectors of the floor boards, so the installation efficiency is further improved, and the installation difficulty is reduced.

Embodiment 4

Figure 6:
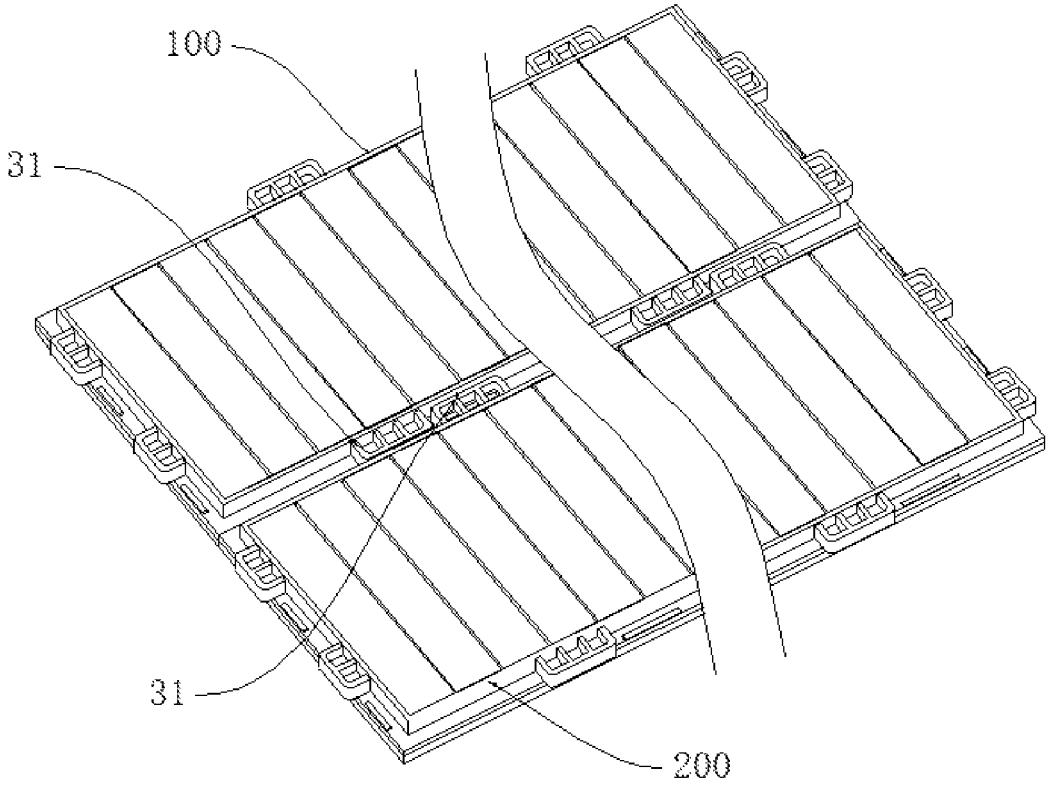
FIG. 6 is a structural diagram showing an assembling of floor boards of rapid side-slide installation according to an embodiment of the present invention.

As shown in FIG. 6, this embodiment is an optimized solution of embodiment 3. The description of the present embodiment focuses on the improvements on embodiment 3, and the identical contents are not repeated herein. In the present embodiment, an upper surface of a protruding portion of the first engaging member 31 is provided with the first engaging portion 310 that protrudes upward. The first engaging portion 310 is a strip block having a semicircular or square part, and chamfers are provided at both ends of the strip block. The two ends of the first engaging portion 310 are provided with the chamfers to facilitate the engagement during assembling. The first limiting groove 34 is formed between the first engaging portion 310 and a side wall of the bottom frame 21. The second limiting groove 33 is formed between the second engaging member 32 and a side wall of the side frame 22. The second engaging member 32 is a strip block with a semicircular or square cross-section, and chamfers are provided at both ends of the strip block. The two ends of the second engaging member 32 are provided with the chamfers to facilitate the engagement during assembling. During assembling, the first engaging portion 310 slides into the second limiting groove 33 of the floor board to be assembled with the floor board of the first engaging portion, and the second engaging member 32 slides into the first limiting groove 34 of the floor board to be assembled with for matching positioning. In the present embodiment, the two floor boards are turned over by 180 degrees. In practical installation, the upper surface of the floor board faces upward. When the two floor boards are aligned and assembled together, the first engaging portion 310 (not shown in FIG. 6) of the first engaging member 31 of the first floor board 100 is matched and engaged with the second limiting groove 33 (not shown in FIG. 6) of the second floor board 200. The second engaging member 32 of the first floor board 100 (not shown in FIG. 6) is matched and engaged with the first limiting groove 34 (not shown in FIG. 6) of the second floor board 200. The first engaging portion 310 (not shown in FIG. 6) of the first engaging member 31 of the second floor board 200 is matched and engaged with the second limiting groove 33 (not shown in FIG. 6) of the first floor board 100. The second engaging member 32 of the second floor board 200 (not shown in FIG. 6) is matched and engaged with the first limiting groove 34 (not shown in FIG. 6) of the first floor board 100. With the limiting function of the first engaging portion 310 and the second limiting groove 33, and the second engaging member 32 and the first limiting groove 34, the first floor board 100 and the second floor board 200 are relatively fixed to each other, have a simple installation, and are reusable.

Embodiment 5

This embodiment is an optimized solution of embodiment 4. The description of the present embodiment focuses on the improvements on embodiment 4, and the identical contents are not repeated herein. In the present embodiment, a width of the first limiting groove 34 is greater than or equal to a width of the second engaging member 32, and a width of the second limiting groove 33 is greater than or equal to a width of the first engaging portion 310. In order to improve the fixation of the assembled floor boards, the width of the first limiting groove 34 is equal to the width of the second engaging member 32, and the width of the second limiting groove 33 is equal to the width of the first engaging portion 310, so as to improve the fixation after assembling.

Preferably, a length of the first engaging portion 310 is equal to a length of the second limiting groove 33.

Preferably, a length of the second engaging member 32 is equal to a length of the first limiting groove 34.

Embodiment 6

This embodiment is an optimized solution of embodiment 4. The description of the present embodiment focuses on the improvements on embodiment 4, and the identical contents are not repeated herein. In the present embodiment, a length of the first engaging portion 310 is equal to a length of the second engaging member 32, and a height of the first engaging portion 310 is equal to a height of the second engaging member 32, so as to facilitate the assembling of the floor boards. Also, the engagement of the first engaging portion 310 and the second limiting groove 33, and the engagement of the second engaging member 32 and the first limiting groove 34 are firmer.

Embodiment 7

As shown in FIG. 5, this embodiment is an optimized solution of embodiment 3. The description of the present embodiment focuses on the improvements on embodiment 3, and the identical contents are not repeated herein. In the present embodiment, the board body 1 is no longer a single-layer of solid wood floor board, and the board body 1 may be:

A. a plant fiber base material of a pure solid wood floor board, a plant fiber base material of a pure solid wood furniture board, or a plant fiber base material of a pure solid wood decorative board;

B. a plant fiber base material of a floor board of a plywood or veneered plywood, a plant fiber base material of a furniture board of a plywood or veneered plywood, or a plant fiber base material of a decorative board of a plywood or veneered plywood;

C. a plant fiber base material of a floor board of a fiber board or veneered fiber board, a plant fiber base material of a furniture board of a fiber board or veneered fiber board, or a plant fiber base material of a decorative board of a fiber board or veneered fiber board;

D. a plant fiber base material of a floor board of a shaving board or veneered shaving board, a plant fiber base material of a furniture board of a shaving board or veneered shaving board, or a plant fiber base material of a decorative board of a shaving board or veneered shaving board;

E. a base board of a floor board of an artificial board or a veneered artificial board, a base board of a furniture board of an artificial board or a veneered artificial board, or a base board of a decorative board of an artificial board or a veneered artificial board;

F. a base board of a floor board of a rift grain laminated timber, a base board of a furniture board of a rift grain laminated timber, or a base board of a decorative board of a rift grain laminated timber;

G a base board of a floor board of a laminated oriented strand board or a veneered laminated oriented strand board, a base board of a furniture board of a laminated oriented strand board or a veneered laminated oriented strand board, or a base board of a decorative board of a laminated oriented strand board or a veneered laminated oriented strand board;

H. a base board of a floor board of a block board or veneered block board, a base board of a furniture board of a block board or veneered block board, or a base board of a decorative board of a block board or veneered block board;

I. a base board of a floor board of a finger-jointed board or veneered finger-jointed board, a base board of a furniture board of a finger-jointed board or veneered finger-jointed board, or a base board of a decorative board of a finger-jointed board or veneered finger-jointed board;

J. a base board of a floor board of a integrated board or veneered integrated board, a base board of a furniture board of a integrated board or veneered integrated board, or a base board of a decorative board of a integrated board or veneered integrated board;

K. a base board of a floor board of a wood-plastic composite board or veneered wood-plastic composite board, a base board of a furniture board of a wood-plastic composite board or veneered wood-plastic composite board, or a base board of a decorative board of a wood-plastic composite board or veneered wood-plastic composite board;

L. a base board of a decorative board of a gypsum board or veneered gypsum board;

M. a base board of a floor board of a magnesium oxide board or veneered magnesium oxide board, a base board of a furniture board of a magnesium oxide board or veneered magnesium oxide board, or a base board of a decorative board of a magnesium oxide board or veneered magnesium oxide board;

N. a base board of a floor board of a bamboo splicing board or veneered bamboo splicing board, a base material of a furniture board of a bamboo splicing board or veneered bamboo splicing board, or a base material of a decorative board of a bamboo splicing board or veneered bamboo splicing board;

O. a base board of a floor board of a plywood bonded with crop straw, residue and mineral powder or veneered plywood bonded with crop straw, residue and mineral powder, a base board of a furniture board of a plywood bonded with crop straw, residue and mineral powder or veneered plywood bonded with crop straw, residue and mineral powder, or a base board of a decorative board of a plywood bonded with crop straw, residue and mineral powder or veneered plywood bonded with crop straw, residue and mineral powder;

P. a base board of a stone-plastic floor board, a base board of a wood plastic composite (WPC) floor board, a base board of a luxury vinyl tile (LUT) floor board, or a ceramic tile.

The board body 1 may be a double-layer or multi-layer composite floor board as well. The board body 1 is composed of a front board 11 provided on the upper surface and a back board 12 connected to the front board 11 and provided on the bottom surface, and the back board 12 is provided on the back surface of the front board 11. In the present embodiment, a hardwood of miscellaneous tree is selected as the raw material for the front board 11. For example, the wood may be a valuable wood such as an oak wood, an elm wood, a black walnut wood, etc., having a water content ranging from 8% to 10% by weight, a thickness ranging from 3 mm to 4 mm. The length and width should meet the requirements of the mold size of the injection molding machine after milling and shaping. A softwood of miscellaneous tree is selected as the raw material for the back board 12. For example, the softwood may be from a fast-growing wood species such as a pine wood, or a spruce wood, having a water content ranging from 8% to 11% by weight, and a thickness ranging from 10 mm to 15 mm.

The back board 12 is composed of a plurality of board cores 120. A glue is evenly coated on the back surface of the front board 11. The board cores 120 are initially bonded to the back surface of the front board 11. Then, the front board 11 is placed in a pressing machine with the its back surface facing upward for pressing to obtain a unfinished double-layer solid wood board. The spacing between adjacent board cores 120 ranges from 0.5 mm to 1.5 mm to avoid problems of appearance and quality such as the curling up caused by the phenomenon that dry makes the wood contract and wet makes it expand. The first groove 14 is provided at a periphery of the front board 11, the second groove 16 is provided at a periphery of the back board 12, and the bottom frame 21 is provided at a back surface of the front board 11. The back board 12 is provided in a receiving cavity surrounded by the side frame 22. The above embodiments are merely the preferred embodiments of the present invention, and there may be more variations in practical applications. For example, the back board 12 is an unbroken board instead of being spliced by a plurality of board cores 120.

Preferably, an outer edge of the bottom frame 21 is aligned with an outer edge of the front board 11.

Embodiment 8

Figure 7:
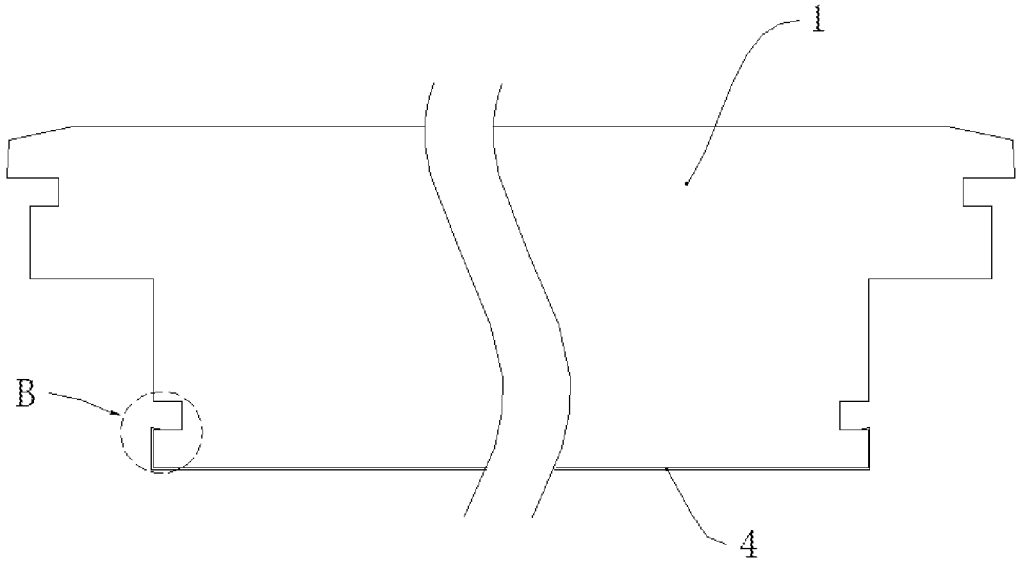
FIG. 7 is a structural schematic diagram of a floor board of rapid side-slide installation with a board body covered with a waterproof film according to an embodiment of the present invention.
Figure 8:
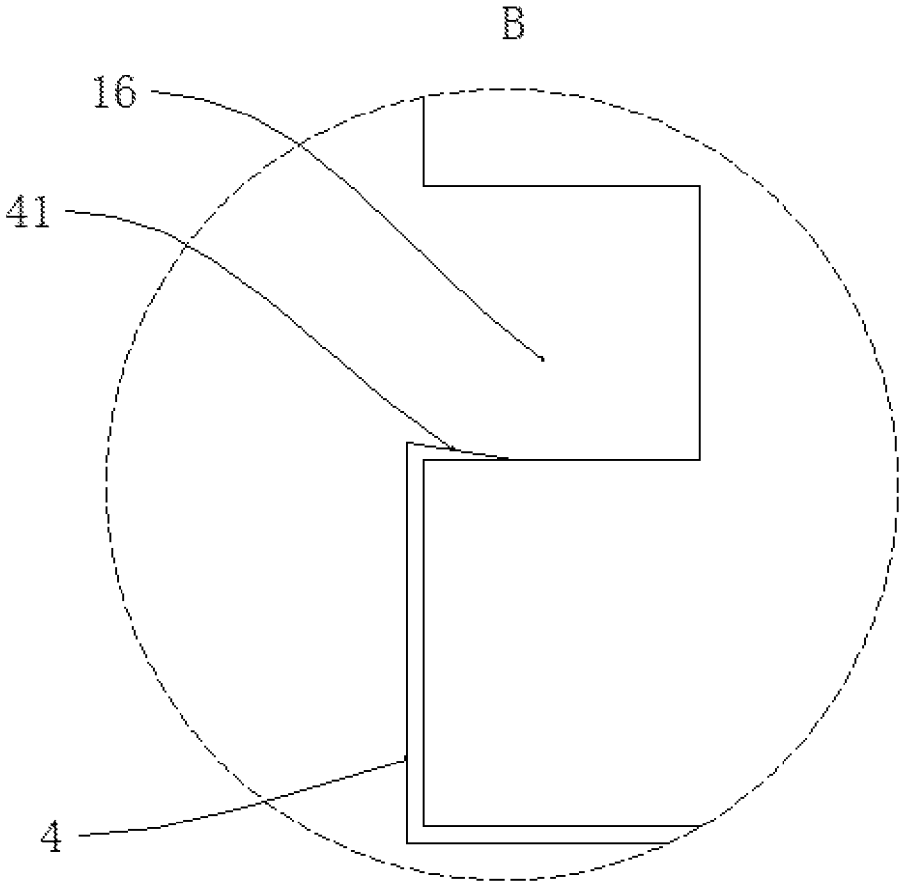
FIG. 8 is an enlarged view of a portion B of FIG. 7.

As shown in FIGS. 7-8, this embodiment is an optimized solution of embodiment 3. The description of the present embodiment focuses on the improvements on embodiment 3, and the identical contents are not repeated herein. In the present embodiment, the bottom surface 102 of the board body is provided with the waterproof film 4, a cross-section of the waterproof film 4 is U-shaped, and an outer edge of the waterproof film 4 is located between the bottom frame 21 and the board body 1. An end of the outer edge of the waterproof film 4 is connected in the second groove 16 in an overlapping manner. The waterproof film 4 has a thickness ranging from 0.08 mm to 0.12 mm, and can withstand high temperatures. The waterproof film 4 may be a polyvinyl chloride (PVC) waterproof film 4. After the waterproof film 4 is attached to the bottom surface 102 of the board body, the plastic frame can be formed on the periphery 13 of the board body by the injection molding. In other embodiments, after applying a paint with a certain thickness on the bottom surface 102 of the board body, the waterproof film 4 is provided on the paint layer, and it is controlled to make the paint have a thickness ranging from 0.05 mm to 0.25 mm after curing. In another embodiment, only the paint with a certain thickness is applied on the bottom surface 102 of the board body, and it is controlled to make the paint have a thickness ranging from 0.05 mm to 0.25 mm after curing without providing the waterproof film 4. The above two methods can also provide the waterproof function for the bottom surface 102 of the board body, and the application of the base paint can improve the wear resistance of the bottom surface.

Embodiment 9

Figure 9:
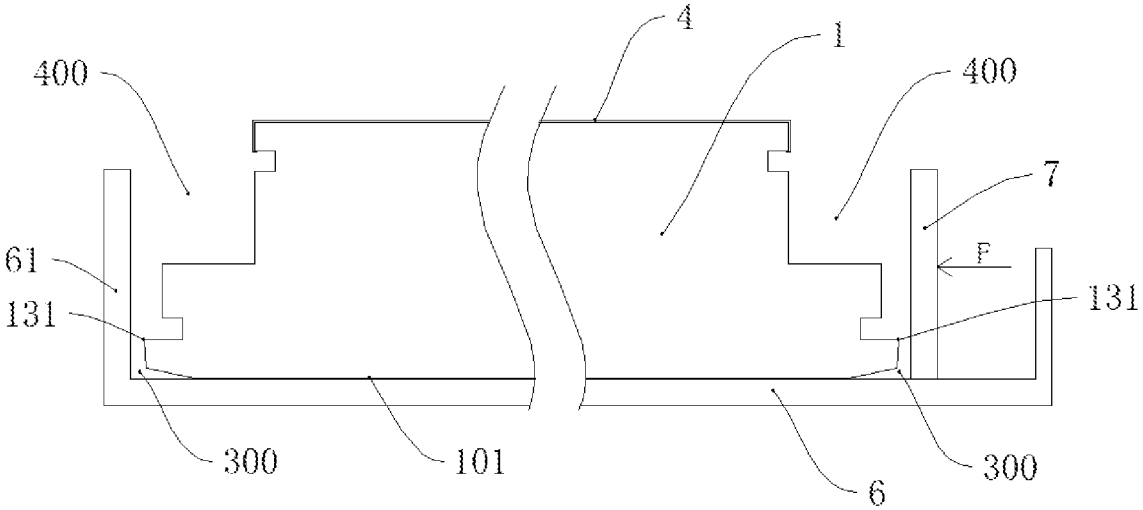
FIG. 9 is a schematic diagram showing an injection molding of the board body of a floor board of rapid side-slide installation according to an embodiment of the present invention.

As shown in FIG. 9, this embodiment is an optimized solution of any one of embodiments 1-8. The description of the present embodiment focuses on the improvements on embodiments 1-8, and the identical contents are not repeated herein. In the present embodiment, the plate body 1 to which the waterproof film 4 is attached or having its bottom surface 102 coated with the paint is placed in the lower mold 6 in inversion, so the upper surface 101 of the board body is closely fitted with the surface of the lower mold 6. The first sliding block 7 is pushed toward the left in the direction of the force F, so that the left and right sides of the board body 1 are sandwiched between the first sliding block 7 and the fixed side wall 61 of the lower mold 6. Similarly, the front and rear sides of the board body 1 are sandwiched between the second sliding block (not shown in FIG. 9) and the fixed side wall 61 of the lower mold 6. The protruding edge 131 of the periphery 13 of the board body is fitted with the fixed side wall 61 of the lower mold 6, the first sliding block 7, and the second sliding block, so that the first space 300 between the protruding edge 131 of the periphery 13 of the board body and the upper surface 101 of the board body is isolated with the second space 400 between the protruding edge 131 of the periphery 13 of the board body and the bottom surface 102 of the board body. After the upper mold is put on, the injection molding is performed in the injection molding machine. The molten plastic material is injected into the second space 400. After the mold is cooled and opened, the plastic frame 2 is formed at the periphery 13 of the board body. Since the first space 300 is isolated with the second space 400 by the protruding edge 131 of the periphery 13 of the board body, and the molten plastic material cannot enter the first space 300 from the second space 400, after the injection molding, no redundant plastic material is left on the upper surface 101 of the board body, and no secondary treatment is required. Thus, the processes for manufacturing the floor board of rapid side-slide installation are reduced, and the production cost is lowered. After the injection molding, the upper surface 101 of the board body is painted to form the third paint layer 5 on the upper surface, so as to achieve the decorative and waterproof properties of the upper surface.

In the present embodiment, the molten plastic material may be polyethylene, polypropylene, polyvinyl chloride, polystyrene, polyoxymethylene, poly chromium carbonate, acrylic plastic, polyolefin and copolymer thereof, polysulfone, polyphenylene ether, a thermoplastic composed of chlorinated polyether, a hot melt adhesive, or a thermoplastic elastomer. The materials listed above are the commonly used thermoplastics, they can be applied in the present invention and achieve good effects.

The above description merely refers to the preferred embodiments of the present invention, and is not intended to limit the present invention. Any modifications, equivalent substitutions, and improvements made within the spirit and principles of the present invention should be considered as falling within the scope of the present invention.

What is claimed is:

1. A floor board of rapid side-slide installation, comprising: a board body and a plastic frame covering around a periphery of the board body;

wherein, a plurality of sets of limiting connectors are provided on the plastic frame, two adjacent board bodies are fixed with each other by an engagement of the corresponding limiting connectors on the plastic frame of the peripheries of the board bodies, wherein a first groove is provided on the periphery of the board body beside an upper surface of the board body, and a protruding boss having an inclined side surface is formed between a top surface of the first groove and the upper surface of the board body;

an angle between the inclined side surface and the top surface of the first groove is an acute angle;

the plastic frame is provided under the protruding boss and embedded in the first groove, and an outer side wall of the plastic frame and a protruding edge of the protruding boss are on a same vertical plane.

2. The floor board of rapid side-slide installation of claim 1, wherein the angle between the inclined side surface and the top surface of the first groove ranges from 80° to 89°.

3. The floor board of rapid side-slide installation of claim 2, wherein an area of the upper surface of the board body is larger than an area of a bottom surface of the board body, the periphery of the board body is located between the upper surface and the bottom surface, the periphery of the board body is provided in a stepped shape, a second groove is provided in the periphery of the board body beside the bottom surface of the board body, and the plastic frame is embedded in the second groove.

4. The floor board of rapid side-slide installation of claim 3, wherein the plastic frame comprises a bottom frame and a side frame provided at an inner side of the bottom frame and integrally formed with the bottom frame; each set of the limiting connectors comprises a first engaging member and a second engaging member, the first engaging member and the second engaging member are adjacent to each other; the first engaging member protrudes outward from a side wall of the side frame, and the first engaging member is connected to a bottom surface of the bottom frame; the second engaging member protrudes downward from the bottom surface of the bottom frame, and the first engaging member and the second engaging member on two sides of the side frame are arranged in a staggered manner, wherein, a distance between the first engaging member in one set of limiting connectors and the second engaging member in the adjacent set of limiting connectors is greater than a length of the first engaging member.

5. The floor board of rapid side-slide installation of claim 4, wherein an upper surface of a protruding portion of the first engaging member is provided with a first engaging portion protruding upward, a first limiting groove is formed between the first engaging portion and a side wall of the bottom frame, a second limiting groove is formed between the second engaging member and a side wall of the side frame; the first engaging portion is configured to slide into the second limiting groove of the floor board to be assembled with the floor board during assembling, the first engaging portion, and the second engaging member slides into the first limiting groove of the floor board to be assembled with for matching and positioning.

6. The floor board of rapid side-slide installation of claim 5, wherein a width of the first limiting groove is greater than or equal to a width of the second engaging member, and a width of the second limiting groove is greater than or equal to a width of the first engaging portion.

7. The floor board of rapid side-slide installation of claim 4, wherein the first engaging portion is a strip block having a semicircular or square cross-section, and chamfers are provided at both ends of the strip block.

8. The floor board of rapid side-slide installation of claim 4, wherein the second engaging member is a strip block having a semicircular or square cross-section, and chamfers are provided at both ends of the strip block.

9. The floor board of rapid side-slide installation of claim 4, wherein a length of the first engaging portion is equal to a length of the second limiting groove.

10. The floor board of rapid side-slide installation of claim 9, wherein a length of the second engaging member is equal to a length of the first limiting groove.

11. The floor board of rapid side-slide installation of claim 10, wherein a length of the first engaging portion is equal to the length of the second engaging member, and a height of the first engaging portion is equal to a height of the second engaging member.

12. The floor board of rapid side-slide installation of claim 4, wherein the board body comprises a front board provided on the upper surface and a back board connected to the front board and provided on the bottom surface, the first groove is provided on a periphery of the front board, the second groove is provided on a periphery of the back board, the bottom frame is provided at a back surface of the front board, and the back board is provided in a receiving cavity surrounded by the side frame.

13. The floor board of rapid side-slide installation of claim 12, wherein an outer edge of the bottom frame is aligned with an outer edge of the front board.

14. The floor board of rapid side-slide installation of claim 12, wherein the back board comprises a plurality of board cores, and a spacing between adjacent board cores ranges from 0.5 mm to 1.5 mm.

15. The floor board of rapid side-slide installation of claim 4, wherein the bottom surface of the board body is provided with a waterproof film, a cross-section of the waterproof film is U-shaped, and an outer edge of the waterproof film is located between the bottom frame and the board body.

16. The floor board of rapid side-slide installation of claim 15, wherein an end of the outer edge of the waterproof film is connected in the second groove in an overlapping manner.

17. The floor board of rapid side-slide installation of claim 15, wherein the waterproof film has a thickness ranging from 0.08 mm to 0.12 mm.

18. The floor board of rapid side-slide installation of claim 15, wherein a first paint layer is further provided between the waterproof film and the board body, and the first paint layer has a thickness ranging from 0.05 mm to 0.25 mm.

19. The floor board of rapid side-slide installation of claim 1, wherein the bottom surface of the board body is provided with a second paint layer, and the second paint layer has a thickness ranging from 0.05 mm to 0.25 mm.

20. The floor board of rapid side-slide installation of claim 1, wherein the upper surface of the board body is provided with a third paint layer.

* * * * *